US006519907B1

(12) United States Patent
Weissinger

(10) Patent No.: US 6,519,907 B1
(45) Date of Patent: Feb. 18, 2003

(54) FRAME SECTION TO BE USED AS A MODULAR STRUCTURAL ELEMENT FOR BUILDINGS, METHOD FOR THE PRODUCTION THEREOF

(76) Inventor: Karl-Heinz Weissinger, Eichbergstrasse 19, D-75331 Engelsbrand (DE)

( * ) Notice: Subject to any disclaimer, the term of this patent is extended or adjusted under 35 U.S.C. 154(b) by 0 days.

(21) Appl. No.: 09/381,885

(22) PCT Filed: Mar. 18, 1998

(86) PCT No.: PCT/DE98/00795

§ 371 (c)(1),
(2), (4) Date: Dec. 3, 1999

(87) PCT Pub. No.: WO98/42932

PCT Pub. Date: Oct. 1, 1998

(30) Foreign Application Priority Data

Mar. 25, 1997 (DE) ..... 197 12 347

(51) Int. Cl.[7] ..... E04B 1/61; E04C 2/38

(52) U.S. Cl. ..... 52/582.2; 52/584.1; 52/127.11; 52/745.1; 52/745.19; 144/144.1

(58) Field of Search ..... 52/582.1, 582.2, 52/584.1, 585.1, 784.15, 782.1, 783.1, 792.1, 745.1, 745.19, 127.11, 127.12; 106/772; 144/144.1, 144.5

(56) References Cited

U.S. PATENT DOCUMENTS

| | | | | |
|---|---|---|---|---|
| 1,659,326 A | * | 2/1928 | Meyercord | 52/588.1 |
| 4,072,548 A | * | 2/1978 | Gerson et al. | 52/314 X |
| 4,236,365 A | * | 12/1980 | Wheeler | 52/309.16 X |
| 5,171,366 A | * | 12/1992 | Richards et al. | 106/772 |
| 5,832,692 A | * | 11/1998 | Opferbeck et al. | 52/745.19 |
| 5,945,208 A | * | 8/1999 | Richards et al. | 106/772 X |

* cited by examiner

*Primary Examiner*—Lanna Mai
*Assistant Examiner*—Winnie Yip
(74) *Attorney, Agent, or Firm*—Troutman Sanders LLP; Wm. Brook Lafferty, Esq.

(57) ABSTRACT

Modular construction elements are produced by assembling cross posts and longitudinal posts to form a frame of exact specification having a void between the assembled posts. Planks are affixed to the assembled posts and an insulation medium may be located within the void to enhance performance of the elements. The modular construction elements are interconnected by interposing a joiner therebetween. The joiner has a receptacle casing, a round bolt and a screw structure. When the screw structure is in place and initially engaged with the modular construction elements, it is actuated to urge the elements together in a desirable fashion.

10 Claims, 3 Drawing Sheets

FRAME SECTION TO BE USED AS A MODULAR STRUCTURAL ELEMENT FOR BUILDINGS, METHOD FOR THE PRODUCTION THEREOF

CROSS-REFERENCE TO RELATED APPLICATIONS

This application claims the benefit of the filing date of German Application No. 19712347.3, filed Mar. 25, 1997.

FIELD OF THE INVENTION

Structural frames for use as modular structural units for buildings, as well as the procedure for the manufacture of such a structural frame

BACKGROUND

The present invention refers to a pre-fabricated structural frame, especially a wall unit, consisting of wood beams (hereinafter called posts) or beams of natural stone for use as a modular structural unit for buildings or other such constructions. Furthermore, the invention refers to a procedure for the manufacture of such a structural frame part.

The reason or starting point of the present invention was that it has clearly become increasingly unaffordable to finance the construction of a home. In addition to real estate prices, construction costs play a crucial role.

Although prefabrication technology has been well known for quite some time, conventional prefabricated homes are still relatively expensive. Wooden houses, especially framework houses, have also long been constructed using conventional technology. The problem has been that the finished beams and posts require a relatively large degree of work and are therefore very costly to cut. In addition, the surface must be treated, so that in the end no money is saved.

One particular problem in the construction of the aforementioned prefabricated houses on the one hand and the framework houses on the other hand is that disassembling them generally requires that the houses are (or must be) destroyed.

The task of the present invention is to introduce a structural frame for use in the construction of a building, which can be manufactured extremely inexpensively and which nevertheless satisfies all requirements for stability and durability. The structural frame in accordance with the present invention should guarantee a simple joining or assembly technology, through which the individual structural frames can be relatively simply disassembled without destroying them, and through which they can also be reassembled without difficulty in a new arrangement or combination.

One especially crucial starting point of the present invention involves the positive use or application of by-products from a sawmill (or from a quarry), which are of low quality due to their imprecise measurements.

The present invention is designed in such a way that the posts (wood beams or beams of natural stone) are subject to tolerance, especially rough cut parts, which are joined together in such a way that a structural frame with exactly predetermined overall dimensions (length and width) is created. The opening of the structural framework is covered using planking materials also subject to tolerance, especially rough cut parts; the longitudinal beams, and if necessary the cross beams as well, have grooves lengthwise on the outside, into which sealing wedges are placed during construction in order to improve the sealing effect.

The procedure for the manufacture of these structural frames is also characterized by two cross posts facing one another, which are mounted on an assembly/work table in such a way that their outer dimensions correspond to the predetermined outer dimensions of the structural frame, that the cross posts are cut to length according to the predetermined outer dimensions, that both of the laterally adjoining/ending longitudinal posts are cut and fitted according to the predetermined inner dimensions of the mounted cross posts, and that the cross and longitudinal posts are joined in the corner area.

In other words than those used in the aforementioned secondary claim, the basis of the present invention consists of using roughly measured materials, especially rough cut wood beams or wood boards (as well as stone beams), as the basic materials for modular structural frames and joining these in such a way that—in reference to the crucial outer dimensions of the overall structure—a frame of exact dimensions is created, which can be joined to (and disassembled from) other structural frames of comparable type and size using conventional kit technology.

It is easily understandable that there is a significant decrease in construction costs, not only because of the considerable reduction in the price of construction parts, but also because of the more favorable construction time and the fact that there is no longer a need for heavy equipment.

In consideration of the assembly of structural frames, a (frame) joiner is proposed in the further embodiment of the present invention, which allows—in other words than those used in Claim 5—two structural frames to be pulled together through a combination of a left/right screw thread, until they are sufficiently close to one another.

SUMMARY OF THE INVENTION

The present invention relates to the construction and use of a modular construction element comprising two cross posts of substantially identical predetermined length between remote cross post ends, two longitudinal posts of substantially identical predetermined length between remote longitudinal post ends, and at least two sheets of planking each having substantially identical predetermined dimensions. Each of the cross posts and each of the longitudinal posts has an inner edge and an outer edge, and each of the cross posts is secured at its respective remote cross post ends to a remote longitudinal post end such that each cross post inner edge faces its opposing cross post inner edge and each longitudinal post inner edge faces its opposing longitudinal post inner edge, the respective inner edges of the respective cross posts and longitudinal posts define a void therebetween, in much the same manner as a picture frame.

The respective outer edges of the secured cross posts and the longitudinal posts define a substantially exact predetermined overall dimension of the modular construction element. Furthermore, the substantially identical predetermined dimensions of each of the at least two sheets of planking are substantially the same as the exact predetermined overall dimension of the modular construction element. Accordingly, each of the at least two sheets of planking are affixed to the cross posts and the longitudinal posts in such a manner as to substantially seal the void defined therebetween.

In a preferred embodiment of the present invention, the modular construction elements may be interconnected by placing two of the modular construction elements in general planar alignment. Next, at least one joiner for attaching the respective modular construction elements and for maintaining the respective modular construction elements in general planar alignment is interposed therebetween. In a preferred embodiment, each joiner comprises at least one receptacle casing defining a cylindrical void therethrough, a round bolt for receiving at least one receptacle casing, and at least one screw structure for radial insertion through the receptacle casing and round bolt. Next, the interconnection is completed by engaging the screw structure with each of the two modular construction elements and tightening the screw structure to securely interconnect the modular construction units.

DETAILED DESCRIPTION

The invention is described below only by way of example using the drawings, which show the following:

DETAILED DESCRIPTION OF THE DRAWINGS

Figure 1:
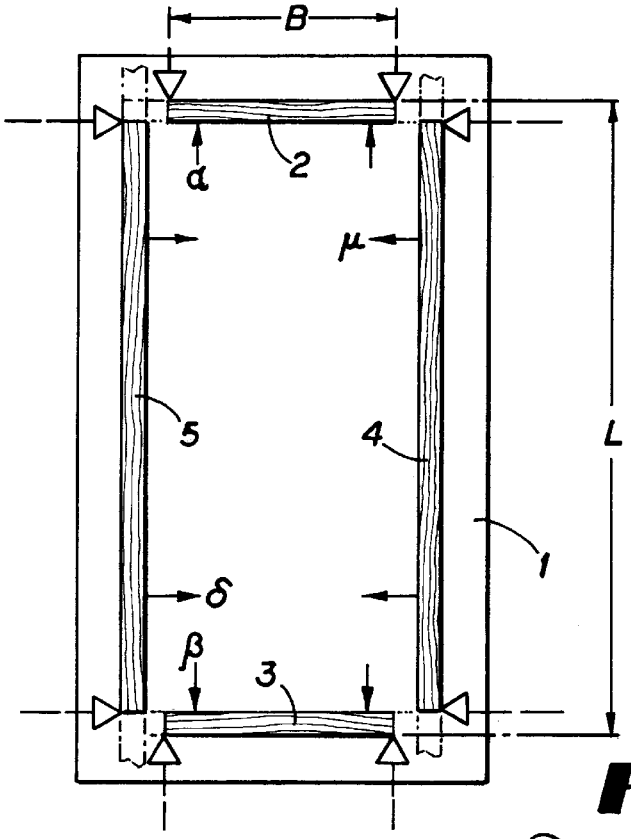
FIG. 1 is a schematic diagram explaining the procedure of manufacturing a structural frame.

FIG. 1 illustrates the basic idea underlying the present invention. This basic idea consists of the economical use of materials subject to tolerance, especially rough cut wood beams and wood boards (posts), which also results in added value, which are joined in a structural frame whose overall dimensions are precisely correct despite the imprecise measurements of the rough cut posts (and whose hollow insulation spaces are filled with insulating materials, especially with by-products from sawmills).

The starting point is an assembly/work table 1 (assembly island) on which the posts are mounted relative to one another and sized (cut). Assuming that the structural frame to be produced is rectangular in shape, a cross post 2 is first placed on and secured to the work table 1 (see arrow ac), parallel to a guide groove (20)—see FIG. 2—alongside which machining tools or such can be used. In the second step, the second cross post 3 is placed on the board and mounted (see arrow β) and secured so that the outsides of both cross posts 2, 3 are exactly parallel to one another; in this step, the outer sides define the exact dimensions of the length L of the structural frame to be produced. Then both cross posts 2, 3 are cut to the length of the width B of the structural frame, at an exact right angle to the outer sides. Next, the first longitudinal post 4 is placed on the board and cut so that it corresponds to the inside measurement of the cross posts 2, 3; this longitudinal post 4 is then inserted between the cross posts 2, 3 (see arrow $\mu$) to fit exactly. The cross posts of 2, 3 and the longitudinal post 4 are only joined to one another in the corner area, so that the lengthwise side of the structural frame is sturdily attached. Then the second longitudinal post 5 is placed on the board, cut to correspond to the inside measurement of the cross posts, and inserted between the cross posts 2, 3 (see arrow δ). The outside of the second longitudinal post 5 is joined on the wall end of cross posts 2, 3.

Figure 2:
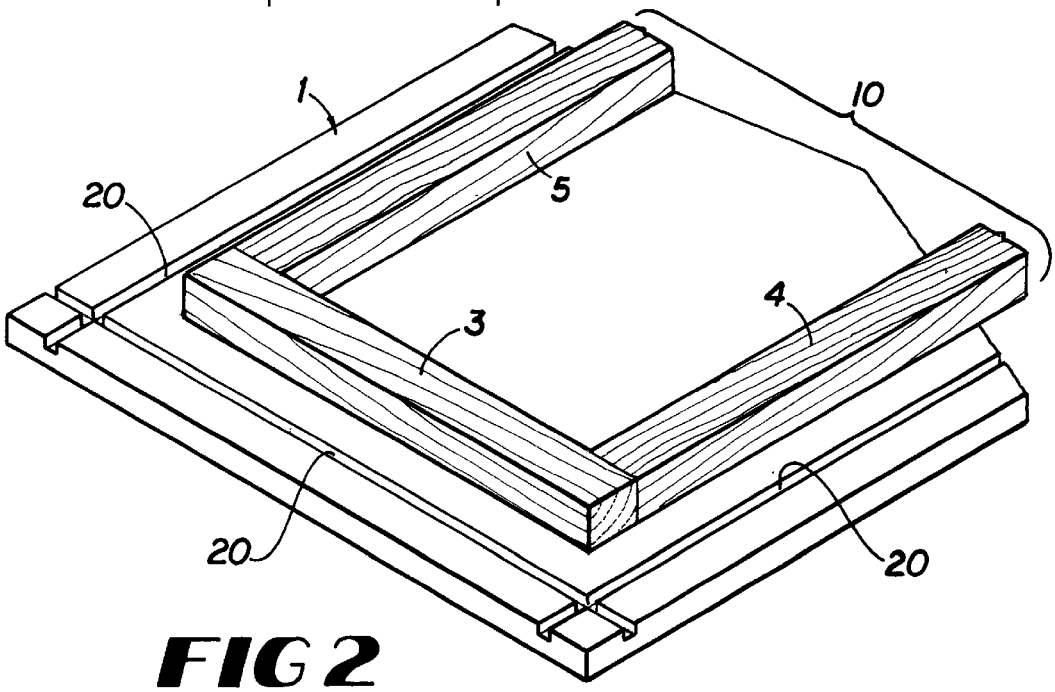
FIG. 2 is an excerpt of one perspective of FIG. 1.

FIG. 2 shows an excerpt of the structural frame 10 produced using the procedure described in FIG. 1, in the area of the second cross post 3 and the two longitudinal posts 4, 5. The illustration in FIG. 2 specifically shows the guide grooves 20 of the assembly/work table, alongside of which the machining, guiding and locking tools can be adjusted and secured in a precise manner.

Figure 3:
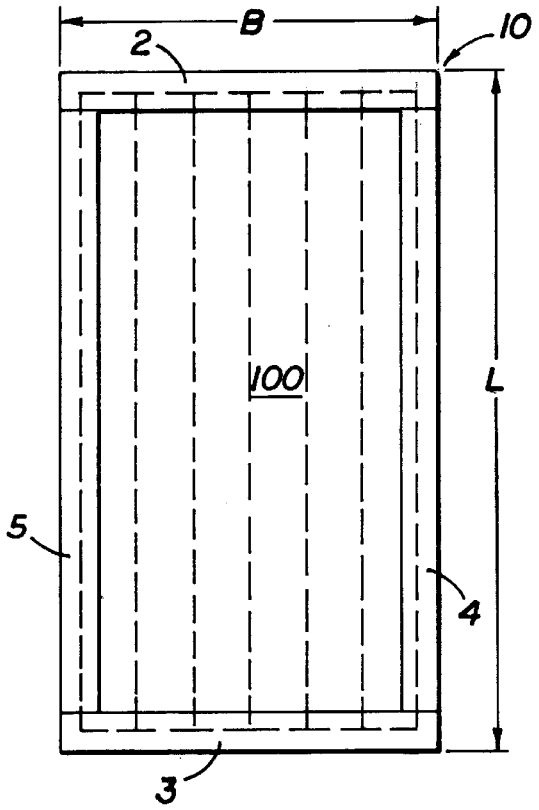
FIG. 3 is an example of a structural frame with exact measurements.

FIG. 3 shows a finished structural frame 10, consisting of two precisely cut cross posts 2, 3 and two inserted longitudinal posts 4, 5 of exact fit. The cross posts 2, 3 on the one hand (through their relation to one another) guarantee the exact measurement of the length L and on the other hand (through their length) and on the other hand, the exact measurement of the width B. When using this frame as a modular unit, the opening between the, cross posts and the longitudinal posts—as indicated by the dotted lines—is then provided with (if necessary, using the so-called board layer procedure producing multilayer) planking 100; the space between the planking 100 can of course be filled with a suitable insulation material.

Figure 4:
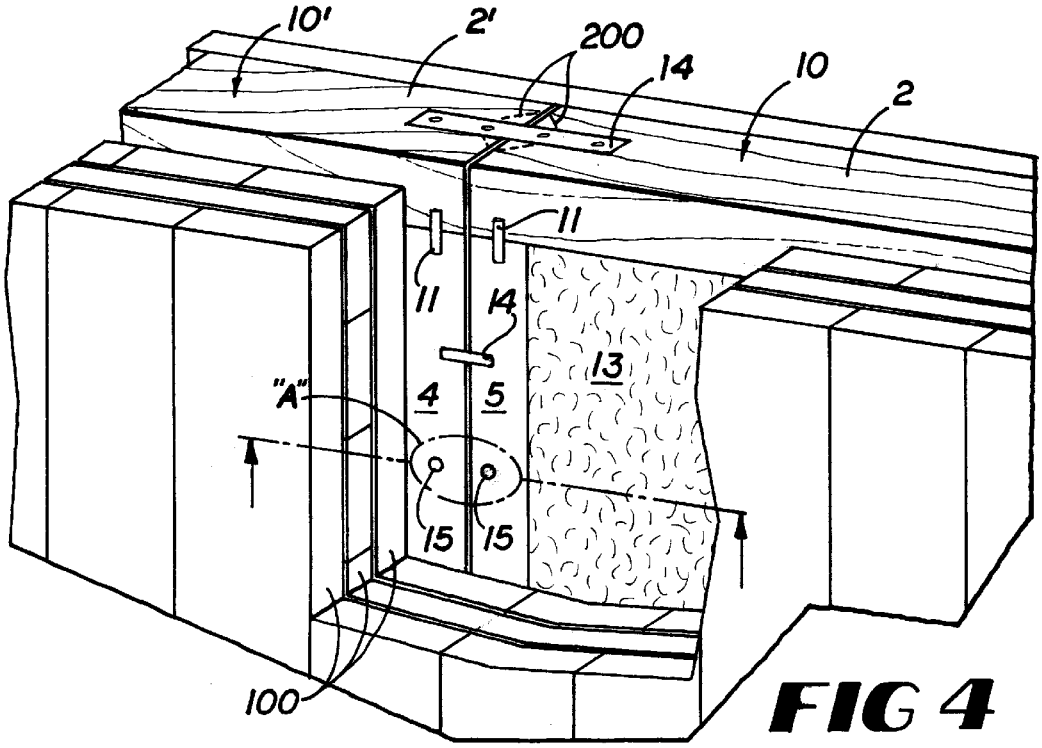
FIG. 4 is an excerpt of one perspective of a wall made up of two assembled structural frames.

FIG. 4 shows an excerpt of an area of wall in the corner area of two—in this case identical—structural frames 10, 10'. This illustration especially clearly shows that the posts in the corner areas of the structural frames 10, 10' are joined together by clamps or dowels 11. The illustration also shows that the openings between the posts are covered with single-layer or multi-layered planking 100 made up of lengthwise and crosswise, or if necessary diagonally placed materials subject to tolerance, particularly rough cut wood beams or boards (or other woodworking materials) which firmly join the structural frames 10, 10'. In the illustration in FIG. 4, it is especially clear to see how the space between the planking 100 and the posts is filled with insulation material 13, especially with wood shavings and/or wood chips (therefore by-products of the sawmill industry).

Figure 5:
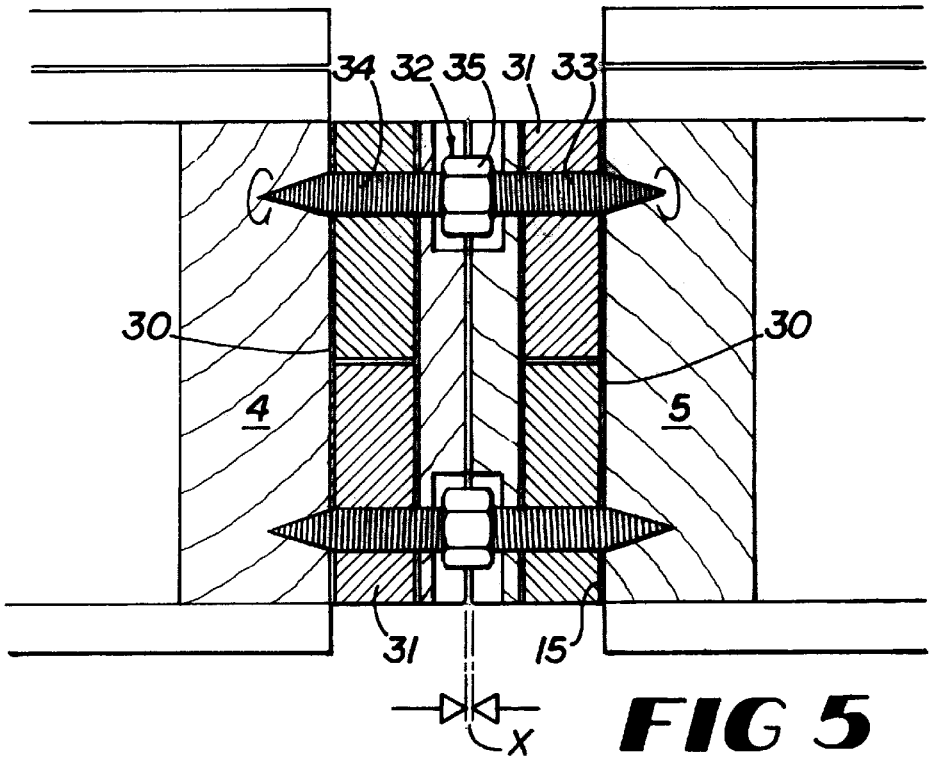
FIG. 5 is a detailed illustration (in accordance with excerpt A of FIG. 4) of the joining of structural frames.

The illustration in FIG. 4 should especially also show how the adjoining structural flames 10, 10' are joined together. The joiners developed in connection with the structural frames 10, 10' in accordance with the present invention (see FIG. 5/FIG. 6) assumes that in each of the structural frames 10, 10' there are receiving drill holes 15 which are spaced at appropriate distances apart, in order to receive the receptacle casings and round bolts—as shown in FIG. 5—which are then pulled together relative to one another through a right/left screw thread combination, until the sides of the frame are sufficiently joined. The structural frames 10, 10' can also be pulled together using additional clamps 14 if necessary. FIG. 4 also illustrates that the longitudinal posts 4, 5 and—as shown here—the wall end of the cross posts 2 or 2' each have grooves 200, in which sealing wedges are placed during assembly. This significantly improves the sealing effect (insulation) of the buildings produced using the structural frame in accordance with the present invention.

FIG. 5 essentially shows excerpt "A" from FIG. 4, explaining and disclosing the joiner of two structural frames 10, 10' in a cross section viewed through the longitudinal posts 4, 5. Each of the longitudinal posts 4, 5—as already mentioned in reference to FIG. 4—has a receiving drill hole 15 into which a receptacle casing 30 is fitted. A round bolt 31 is then placed into each side of this receptacle casing 30. The round bolt 31 includes a screw structure 32, each of which coaxially and diametrically to the round bolts 31 includes a thread base with a right thread 33 and a left thread 34. The two thread bases 33, 34 are located in the receiving holes of the round bolts 31 and can be drilled into the longitudinal post 4, 5 by drilling in the receptacle casings 30 on the inner side of the longitudinal posts 4, 5. Therefore, if the screwing structure 32 is screwed through a central multi-edged base 35, the two longitudinal posts 4, 5 are pulled together through the opposite thread bases 33, 34 (see arrow X).

In accordance with the present embodiment of the invention as shown in FIG. 5, there are two round bolts 31 and one screw structure 32 for each joining/tension part between the two longitudinal posts 4, 5. However, in principle this connection can also be achieved through the screw structure 32 alone. To complete the picture, it should also be noted that the space between the plankings 12 in the area of the joiners is closed with suitable elements and that for disassembly, these structures only need to be removed in order to once again detach the bolted joint.

Figure 6:
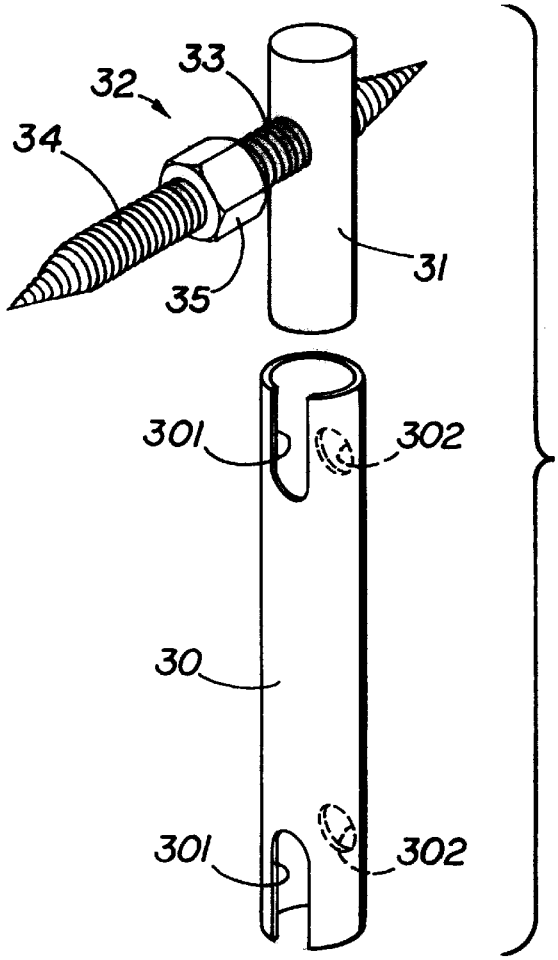
FIG. 6 is an illustration of a joiner in accordance with FIG. 5, in the form of an enlarged drawing.

FIG. 6 shows a receptacle casing 30, a round bolt 31 and a screw element 32 in detail. The receptacle casing 30 has a cut 301 at both wall ends; across from these cuts 301 there is a drilling 302 in the receptacle casing 30. If during assembly the round bolts 31 are inserted in the receptacle casing 30, the screw structure 32, which hangs loose in the round bolt 31, extends through the cut 301 into the interior of the receptacle casing 30. The top of the thread base 33 (or 34) extends through the drilling 302 and penetrates the longitudinal posts 4, 5. The longitudinal posts 4, 5 are pulled together by screwing the multi-edged base 35.

In consideration of the use/processing of materials subject to tolerance, especially rough cut wood beams/wood posts, it should also be noted that sound-proofing is significantly improved as compared to conventional wooden modules.

We claim:

1. A joiner for the installation of side by side structural frames, each structural frame as a modular structural unit for buildings or other such constructions with exactly predetermined overall accurate dimensions of length L and width B, characterized in that the structural frame consists of cross and longitudinal posts, manufactured from dimensionally inaccurate rough cut wood beans, wood boards or manual stone beams subject to tolerance, the rough cut cross posts oriented in a laterally displaced and parallel manner relative to each other to precisely determine the length L of the structural frame and to have the longitudinal posts to be precisely fitted there between, and the rough cut cross posts then having been cut to precisely determine the width B of the structural frame, the cross and longitudinal posts joined to one another in the corner area, characterized in that the joiner includes:

receptacle casings which are spaced a distance apart from one another in receiving drill holes passing through the longitudinal posts of the structural frame, each drill hole configured to receive one of the receptacle casings; and round bolts and screw structures, each screw structure having a pair of threaded bases, each threaded base defining either a left read or a lip thread, a pair of the round bolts adapted to be received within each of the receptacle casings, each screw structure adapted to engage one round bolt in one receptacle casing received in the drill hole of one structural frame and also to engage another round bolt in another receptacle casing received in the drill hole in another structural frame, wherein the longitudinal posts of the side by side structural frames lay flush against one another.

2. A method for interconnecting a fast and second modular construction element, said first and second modular construction elements having at least one longitudinal post comprising the steps of:

a. placing the first and second modular construction elements in general planar alignment;

b. interposing at least one joiner between the first and second modular construction elements for attaching the respective modular construction elements and for maintaining the respective modular construction elements in general planar alignment, the at least one joiner comprising a first and second receptacle casing spaced a distance apart from one another, the first receptacle casing in a first receiving drill hole passing through the longitudinal post of the first modular construction element and the second receptacle casing in a second receiving drill hole passing through the longitudinal post of the second modular construction element, at least one screw structure having a pair of threaded bases, each threaded base defining either a left wad or a right thread, and a first and second round bolt, the round bolts adapted to be received with the first and second receptable casings respectively, the at least one screw structure adapted to engage the first round bolt in the first receptacle casing received in the first drill hole and also to engage the second round bolt in the second receptable casing received in the second drill hole;

c. engaging the at least one screw structure to securely interconnect the modular construction elements; and d. tightening the at least one screw structure to pull the first construction element toward the second construction element and pull the second construction element toward the first construction element, concurrently.

3. A method for the manufacture of a structural frame of predetermined dimensions for construction comprising the following steps in the order named:

mounting two opposing cross posts on an assembly island relative a guide groove in the assembly island;

in response to the mounting step, defining transverse to said cross posts mounted on said assembly island a length L between outer dimensions of the cross posts;

cutting the cross post such that each cross post corresponds in length to a width B; and mounting longitudinal posts on the mounting island between the cross posts, wherein the mounting and the cutting steps result in the outer dimensions of the structural frame to be manufactured being length L and width B.

4. The method in accordance with claim 3, characterized in that the posts are wood beams, wood boards or natural stone beams subject to tolerance, which are produced through sawing to size as rough cut parts.

5. The method in accordance with claim 3, characterized in that there are grooves in the outer sides of die posts, into which a sealing wedge is inserted during assembly.

6. The method in accordance with claim 3, characterized in that the opening between the cross posts and the longitudinal posts is covered with a planking of parts subjected to tolerance.

7. The method accordance with claim 3, characterized in that the planking of the opening is composed of rough cut parts.

8. The method in accordance with claim 3, characterized in that the opening is planked in such way that a space for insulation is formed.

9. The method in accordance with claim 3, characterized in that the insulation space formed through planking can be filled with by-products or waste products.

10. The method accordance with claim 3, characterized in that wood shavings and/or wood chips from saw mills can be selected for by-products or waste products.

* * * * *